US005342347A

United States Patent [19]

Kikuchi et al.

[11] Patent Number: 5,342,347

[45] Date of Patent: Aug. 30, 1994

[54] DRUG CONTAINER AND DUAL CONTAINER SYSTEM FOR FLUID THERAPY EMPLOYING THE SAME

[75] Inventors: Toshihiro Kikuchi, Suita; Koji Ikeda, Osaka; Hitoshi Futagawa, Kusatsu, all of Japan

[73] Assignee: Nissho Corporation, Osaka, Japan

[21] Appl. No.: 928,455

[22] Filed: Aug. 12, 1992

[30] Foreign Application Priority Data

Aug. 29, 1991 [JP] Japan ..... 3-244562

[51] Int. Cl.[5] ..... A61J 1/00

[52] U.S. Cl. ..... 604/415; 604/416; 604/403

[58] Field of Search ..... 604/403, 404, 411, 414, 604/415, 416; 206/219, 221; 215/DIG. 8, 354, 356

[56] References Cited

U.S. PATENT DOCUMENTS

| | | | |
|---|---|---|---|
| 611,520 | 9/1898 | Smith | 215/DIG. 8 X |
| 2,636,493 | 4/1953 | Lockhart | 215/221 X |
| 2,653,609 | 9/1953 | Smith | 604/416 |
| 2,659,370 | 11/1953 | Smith | 604/416 |
| 3,917,063 | 11/1975 | Chibret et al. | 215/DIG. 8 X |
| 4,583,971 | 4/1986 | Bocquet et al. . | |
| 4,614,267 | 9/1986 | Larkin . | |
| 4,757,911 | 7/1988 | Larkin . | |
| 4,936,841 | 6/1990 | Aoki et al. . | |

FOREIGN PATENT DOCUMENTS

| | | |
|---|---|---|
| 225468 | 6/1987 | European Pat. Off. . |
| 2-26506 | 6/1990 | Japan . |
| 91/10417 | 7/1991 | PCT Int'l Appl. . |

OTHER PUBLICATIONS

English translation of JP-A-H2-4375.

*Primary Examiner*—Robert A. Hafer
*Assistant Examiner*—Sam Rimell
*Attorney, Agent, or Firm*—Birch, Stewart, Kolasch & Birch

[57] ABSTRACT

A drug container is sealed by an annular packing arranged on an open end of a container body, a spherical closing member held on the annular packing, and a cap-like holder fitted on the mouth portion of the container body. In use, the drug container is screwed to a solvent container assembly having a partition wall with a pushing rod. The spherical closing member is pushed out from the packing by the pushing rod and then the partition wall is broken out by the holder of the drug container to communicate the container body with the solvent container.

11 Claims, 3 Drawing Sheets

DRUG CONTAINER AND DUAL CONTAINER SYSTEM FOR FLUID THERAPY EMPLOYING THE SAME

BACKGROUND OF THE INVENTION

1. Field of the Invention

The present invention relates to a drug container suitable for aseptically mixing a drug contained therein with a solvent or a diluent contained in another container and to a dual container system for fluid therapy employing the same.

2. Description of the Prior Art

In medical facilities such as hospitals, some drugs are mixed with a solvent or diluent just before use to prepare a parenteral fluid for intravenous drip infusion. Such drugs are generally supplied in the form of powder or a freeze-dried preparation and packaged in a drug container or a vial because of their poor conservation stability in the liquid state or of any other reasons. It is therefore required to mix the drug in the container or vial with a solvent or diluent contained in another container. In this case, the drug container or vial is usually connected to the solvent container by a suitable connecting means such as, for example, a double ended needle or a connecting tube to transfer the solvent or diluent to the drug container. However, such procedures are very troublesome and time-consuming. In addition, there is a fear of contamination of the drug as it is required to make a hole in a stopper of the drug container in air to connect it with the solvent container.

To solve such problems, there have been proposed various drug delivery systems. For example JP-T-S61-501129, corresponding to U.S. Pat. No. 4,583,971, discloses a closed drug delivery system comprising a flexible container having a liquid diluent therein, a capsule coupled to the flexible container, a drug vial having a drug therein and being supported in the capsule, and a means for coupling the capsule to the interior of the flexible container. In this system, the drug vial is communicated with the flexible container through a communicating means arranged in the coupling means, thus making it possible to aseptically mix the drug with the solvent.

U.S. Pat. No. 4,936,841 (corresponding to JP-A-H2-1277) discloses a container system comprising a flexible container containing a diluent, a capsule having a cylindrical connecting portion at its one end and being connected to a mouth portion of the flexible container at the connecting portion, a drug container held in the capsule, and a communicating means arranged in the capsule to form a passage communicating the flexible container with the drug container. In this system, the communicating means is firstly pierced into the drug vial and then pierced into the flexible container to communicate the flexible container with the drug container. Since the flexible container is communicated with the drug container in the closed system, it is possible to aseptically mix the drug with the solvent.

JP-A-H3-37067 discloses a container for infusion fluid comprising a bag member of a thermoplastic resin, a drug vial held in the bag member at the inverted state, a liquid container containing a diluent, a flexible cylindrical member connected to the bag member at one end and to the liquid container at the other end, a communicating means arranged between the drug container and the liquid container and housed in the cylindrical member, and a means for supporting the drug container and the liquid container, said supporting means being positioned between the drug vial and the liquid container so as to prevent the two containers from coming close to each other until aseptic communicating and mixing operations have been completed.

However, it is impossible with these three systems to change the combination of the drug and solvent or diluent as the drug vial is paired with the liquid container.

JP-A-S59-209535, corresponding to U.S. patent Ser. No. 470,105 filed Feb. 28, 1983 and Ser. No. 565,126 filed Dec. 23, 1983, discloses a drug delivery system comprising a first flexible container having an opening at one end, and a second container having a removable stopper and capable of being fixed to the bottom wall of the first container therethrough, and a stopper removing means having a portion engaging with the stopper. JP-B- H2-26506, corresponding to U.S. patent Ser. No. 590,601 filed Mar. 19, 1984, discloses an improved drug delivery system having a structure similar to that of JP-A-S59-209535. Also, JP-A-S62-137056 (corresponding to U.S. Ser. No. 806,782 filed Dec. 9, 1985) and H2-4375 (corresponding to U.S. Ser. No. 138,810 filed Dec. 28, 1987) discloses an improved drug container for use in the drug delivery system of JP-A-S59-209535. These drug delivery systems make it possible to perform substantially aseptic operations as well as to optionally select the combination of a drug with a solvent or diluent as occasion demands.

However, these drug delivery systems are complex in structure and may give an unpleasant feeling to a patient as the stopper of the drug container is dropped into the liquid container.

SUMMARY OF THE INVENTION

It is therefore an object of the present invention to provide a drug container which is simple in structure and can aseptically mix a drug contained therein with a solvent or diluent contained in a separate solvent container without causing a stopper to drop into the solvent container.

Another object of the present invention is to provide a dual container system for fluid therapy which is able to aseptically perform all operations of preparation and delivery procedure of a parenteral fluid or a liquid medicine.

The above and other objects of the present invention are achieved by providing a drug container comprising a bottle-shaped container body, a means for sealing an open end of the container body, and a covering member for covering at least said sealing means and a mouth portion of said container body, characterized in that said container body is provided with a connecting means and a sealing member on the outside wall of a mouth portion thereof and with an annular seat on the inside wall of the mouth portion thereof, and that said sealing means comprises an annular packing of an elastomeric material having an inside diameter smaller than that of the seat of said body and being held on the seat of said container body, a spherical closing member having a diameter larger than the inside diameter of the packing but smaller than the inside diameter of the seat and being held on the packing to close the bore of said packing, and a cap-like holder fitted on the mouth portion of the container body to hold the spherical closing member in place.

In a preferred embodiment, the covering member comprises a cap-like member partially enlarged in diameter on the side of the open end thereof to form an enlarged skirt portion. This cap-like member is put on the mouth portion of the container body and fixed thereto at its enlarged skirt portion.

In another preferred embodiment, the covering member comprises a synthetic resin sheet covering the whole of the drug container.

According to the present invention, there is also provided a dual container system for fluid therapy, which comprises the first and second containers separated from one another, said first container containing a dose of a drug and comprising: a bottle-shaped container body provided with a connecting means and a sealing member on the outside wall of a mouth portion thereof and with an annular seat on the inside wall of the mouth portion thereof; a means for sealing the open end of the container body; and a covering member for covering at least said sealing means and a mouth portion of said container body; said sealing means comprising an annular packing of an elastomeric material having an inside diameter smaller than that of the seat of said container body and being held on the seat of said container body, a spherical closing member having a diameter larger than the inside diameter of the packing but smaller than the inside diameter of the seat and being held on the packing to close the bore of said packing, and a cap-like holder fitted on the mouth portion of the container body to hold the spherical closing member in place, said second container containing a dose of a solvent or diluent and comprising: a solvent container having a mouth portion at either end and being closed at one mouth portion thereof by a rubber stopper; and a cylindrical connecting member for connecting the solvent container to said first container, said cylindrical connecting member being connected at one end thereof to the other mouth portion of said solvent container and sealed at the opposite end by a sealing member.

In a preferred embodiment, the connecting member has a means for engaging with the first container on an inside wall thereof, a partition wall integrally connected thereto near the one end thereof where the solvent container is connected thereto, and a pushing rod extending coaxially from the central portion of the partition wall toward the opposite end of the connecting member. A hollow portion defined by the inside wall and partition wall of the connecting member has a configuration corresponding to that of the mouth portion of the first container. The partition wall is provided with an annular brittle portion coaxially around the pushing rod to make the partition wall easily breakable. Also, several grooves are formed in both sides of the partition wall to provide passages for fluid extending radially from the base of the pushing rod towards the brittle portion.

These and other objects, features and advantages of the present invention will become apparent from the following description taken in conjunction with the preferred embodiments thereof with reference to the accompanying drawings in which like parts are designated by like reference numerals throughout the drawings.

DETAILED DESCRIPTION OF THE PREFERRED EMBODIMENTS

Figure 1:
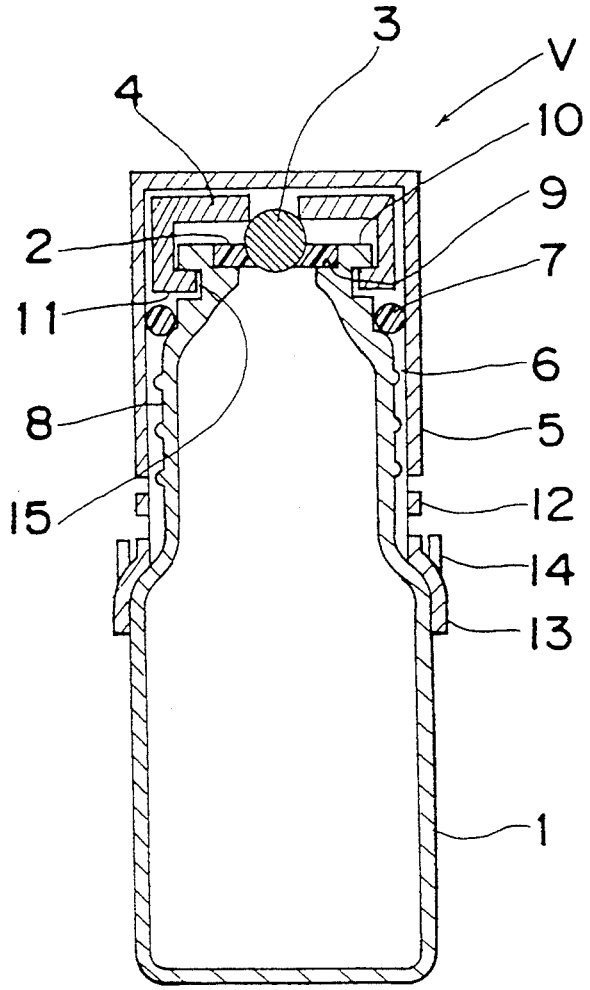
FIG. 1 is a cross-section view of a drug container showing one embodiment of the present invention.

Referring to FIG. 1, there is shown a drug container V according to the present invention. The drug container V comprises a container body 1, an annular packing 2 arranged on the inside wall of a mouth portion 8 of the body 1, a spherical closing member 3 held on the packing 2, a holder 4 fitted on the mouth portion 8 of the body 1 to hold the spherical closing member 3 in place, and a covering member 5 fixed to the body 1 so as to cover the holder 4 and the outside wall of the mouth portion 8.

The container body 1 is a bottle-shaped container, or a bottom-closed cylindrical member reduced in diameter at an open end thereof to form a narrow mouth portion 8. Preferably, the container body 1 is made of a transparent material such as, for example, glass or synthetic resins including polypropylene resins and polyester. The mouth portion 8 of the container body 1 is provided with a connecting means (generally a male screw) 6 and a sealing member (generally O-ring) 7 to fluidtightly and firmly connect the container body 1 with a solvent container assembly S explained later. Around the mouth portion 8 there may be provided a circumferential groove for holding the sealing means 7 such as an O-ring for example.

In the inside wall of the mouth portion 8 of the container body 1 and close to the open end, there is provided an annular packing seat 9 to hold the packing 2. The packing seat 9 may be formed by providing an inwardly extending annular projection on the inside wall of the mouth portion or by providing an upwardly extending annular projection on the open end of the mouth portion. However, the packing seat 9 may take any shape provided that it can hold the packing 2 in place and prevent it from falling off therefrom even when an external force is applied to the packing 2 in a direction perpendicular to the packing seat 9.

The container body 1 is provided with an annular groove 15 adjacent to the open end of the mouth portion 8 thereof to provide a means for engagement with the holder 4.

The packing 2 is made of an elastomeric material such as butyl rubber, styrene-butadiene rubber, isoprene rubber, urethane rubber, and nitrile rubber in the form of an annular member or a disk-like member with a central bore which has a diameter smaller than that of the spherical closing member 3.

The spherical closing member 3 has a diameter smaller than the inside diameter of the mouth portion 8 but larger than the inside diameter of the packing 2. The spherical closing member 3 is generally made of glass or a synthetic resin. However, the spherical closing member may be made of any other material, provided that it has a good chemical-resistance and provides a smooth surface. This spherical closing member 3 may be used in combination with a thick cylindrical packing having a spherical bore therein to hold it in place.

The holder 4 is a cap-like member and generally made of a flexible resin. Typical flexible resins as a material for the holder includes, without being limited to, polypropylene, polyethylene, polycarbonate, polyester, polyvinyl chlorides and the like. At the central part of the top wall of the holder 4, there is provided a bore having a diameter smaller than that of the spherical closing member 3 to allow a pushing rod of the solvent container assembly to pass therethrough when connecting the drug container to the solvent container assembly. The holder 4 is provided at the lower end with an inwardly extending rib 11 adapted to be engaged with a flange 10 of the container body 1. The holder 4 is snapped on the mouth portion 8 of the container body 1 to hold the spherical closing member 3 in place as well as to press it to the packing 2.

The covering member 5 is in the form of a cap or a cylindrical member closed at one end but open at the other end. A skirt portion (side wall) of the covering member 5 is partially enlarged in diameter on the side of the open end to form an enlarged skirt portion 13, at which the covering member 5 is fixed to the container body 1 to protect the sealing means (2, 3, 4) and the mouth portion 8 of the container body 1 from contamination with bacteria. The covering member 5 is provided with upwardly extending projections 14 spaced equally around the circumference of the enlarged skirt portion 13. Immediately adjacent the enlarged skirt portion 13, the covering member 5 is provided with a brittle or frangible portion 12 to allow the covering member 5 to be twisted off easily by turning it, while leaving the enlarged skirt portion 13 on the container body 1. The projections 14 are provided to prevent the drug container V from looseness of the screw connection with the solvent container assembly S.

Figure 2:
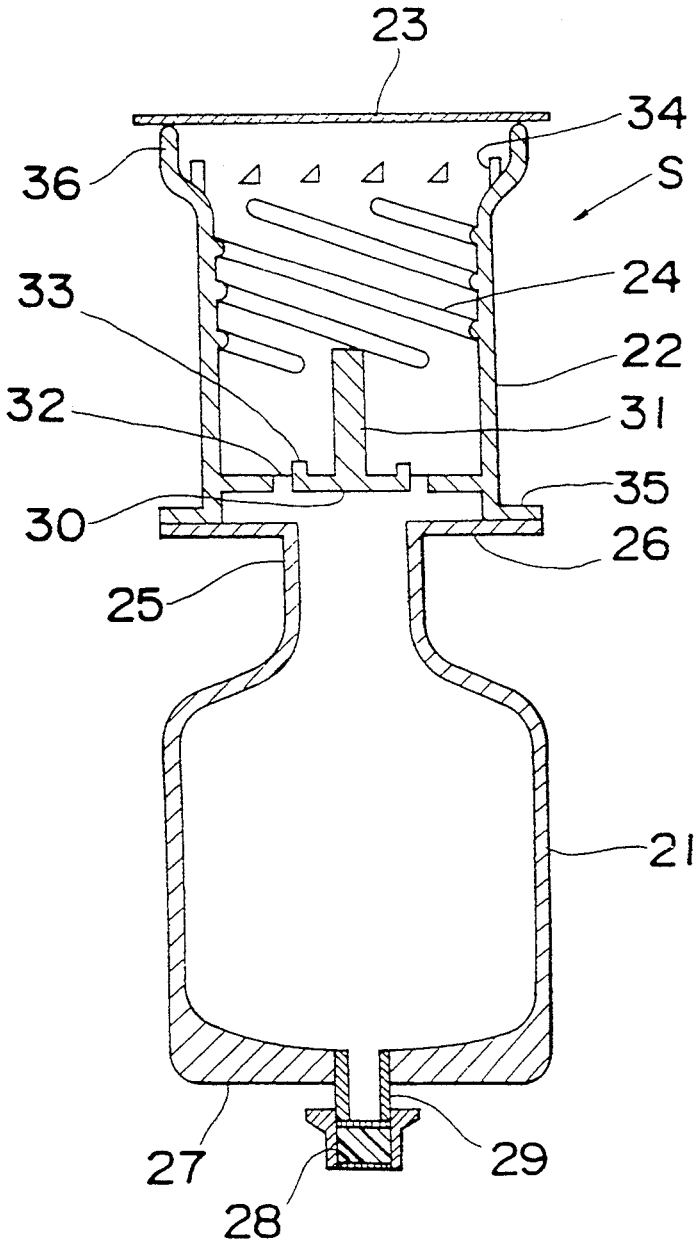
FIG. 2 is a cross-sectional view of a solvent container assembly to be used in combination with the drug container of FIG. 1.

The drug container V may be used in combination with a solvent container assembly S as shown in FIG. 2.

Referring now to FIG. 2, there is shown a solvent container assembly S which comprises a solvent container 21 containing a dose of a solvent or diluent, a cylindrical connecting member 22, and a sealing member 23 used for sealing an open end 36 of a connecting member 32.

The solvent container 21 is a bottle-shaped container having a mouth portion 25, 29 at either end. The mouth portion 29 provided at the bottom of the solvent container serves as an outlet for a solution prepared by mixing the drug and the solvent. The solvent container 21 may take any other shape or configuration as occasion demands. The mouth portion 29 is sealed by a rubber stopper 28 fitted thereon.

The connecting member 22 is a cylindrical hollow body and is enlarged in diameter on the upper side thereof so that it has a hollow portion having a configuration corresponding to that of the mouth portion 8 of the drug container V. On the inside wall of the connecting member 22, there is provided a female screw 24 adapted to be engaged with the male screw 6 of the drug container V. The connecting member 22 is provided at a lower end thereof with a flange 35 fixed to a flange 26 of the mouth portion 25 of the solvent container 21.

The lower end of the connecting member 22 is closed by a partition wall 30 integrally connected thereto near the flange 35. The partition wall 30 has a pushing rod 31 extending coaxially with the connecting member 22 in the direction toward the upper open end 36 of the connecting member 22. Also, the partition wall 30 has an annular brittle or frangible portion 32 formed coaxially with the pushing rod 31 to allow the partition wall 30 to be easily broken by the holder 4 of the drug container V when the solvent container assembly S is screwed thereon.

The partition wall 30 is provided in its both sides with several grooves (not shown) radially extending from the base of the pushing rod 31 towards the brittle portion 32 to form passages for the solvent when the partition wall 30 comes into contact with the flange 26 of the solvent container 21 or the holder 4 of the drug container V. As illustrated in FIG. 2, however, when the partition wall 30 has an annular rib 33 surrounding the pushing rod 31, it is sufficient to provide several grooves or cut in the annular rib 33 instead of the grooves to be formed in the upper surface of the partition wall 30. The connecting member 22 is further provided with a plurality of projections 34 adapted to be engaged with the projections 14 of the enlarged skirt portion 13 remaining on the container body 1. The upper open end 36 of the connecting member 22 is sealed by a suitable sealing means such as, for example, a laminated film 23 of aluminum foil with polyester as the external layers.

In general, the above drug container V and the solvent container assembly S are separately packaged in a suitable plastic sheet to keep them in sterile conditions until just before use.

The above two containers are combined with each other to constitute a liquid transfusion system or a dual container system for fluid therapy.

To make the dual container system ready for use, the covering member 5 is twisted off from the drug container V by turning it clockwise or counterclockwise, while retaining the enlarged skirt portion 13 of the covering member 5 on the drug container V. On the other hand, the laminated film 23 of the solvent container assembly S is peeled off from the connecting member 22.

Figure 3:
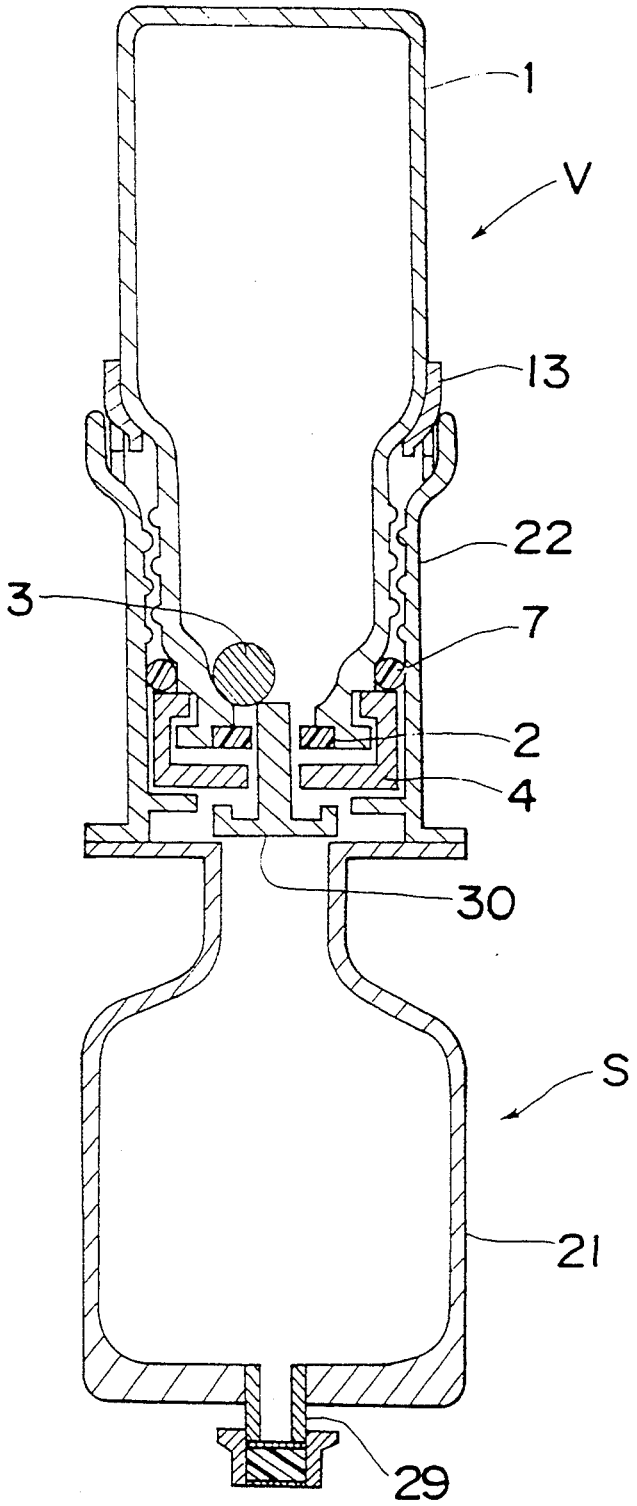
FIG. 3 is a cross section of a dual container system for fluid therapy comprising a drug container of FIG. 1 and a solvent container assembly of FIG. 2, illustrating a state of use.

Then, the solvent container assembly S is connected to the drug container V by screwing the connecting member 22 on the mouth portion 8 of the drug container V. During this operation,-the .spherical closing member 3 is forced out of the packing 2 and dropped into the drug container V by the pushing rod 31 of the connecting member 22. By further screwing the solvent container assembly S, the holder 4 is brought into contact with the annular projection 33 on the partition wall 30 of the solvent container assembly S, so that the partition wall 30 is pressed toward the solvent container 21 and then broken at the brittle portion 32, as shown in FIG. 3. At the same time, the container body 1 communicates with the solvent container 21 through a broken part and the grooves formed in the partition wall 30. Also, the clearance between the mouth portion 8 of the drug container V and the inside wall of the connecting member 22 is sealed by the sealing member 7.

The assembled dual container system is turned upside down to allow the solvent in the solvent container 21 to flow into the container body 1 through the broken part and the grooves in the partition wall 30, shaken to prepare a homogeneous solution, and then turned upside down again to allow the solution in the container body 1 to flow into the solvent container 21. The resultant solution may be used for intravenous drip infusion by connecting the mouth portion 29 of the solvent container 21 to a solution infusion set.

As will be understood from the above, according to the present invention, it is possible to provide a drug container which is simple in construction, easy to handle, and low in manufacture costs, and enables aseptic operations. Also, the present invention makes it possible to provide a drug transfusion system which makes it possible to arbitrarily determine the combination of the drug container and the solvent container as occasion demands. In addition, the use of the drug container of the present invention set a patient at ease as the stopper is prevented from falling into the solvent container.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A dual container system for fluid therapy comprising first and second containers separate from one another, said first container containing a dose of a drug and including a bottle-shaped container body provided with a connecting means and a first sealing member on the outside wall of a mouth portion thereof and with an annular seat on the inside wall of the mouth portion thereof, means for sealing the open end of the container body, and a cover member for covering at least said sealing means and a mouth portion of said container body, said sealing means comprising an annular packing of an elastomeric material having an inside diameter smaller than that of the seat of said container body and being held on the seat of said container body, a spherical closing member having a diameter larger than the inside diameter of the packing but smaller than the inside diameter of the seat and being held on the packing to close the bore of said packing, and a cap-like holder fitted on the mouth portion of the container body to hold the spherical closing member in place;

said second container including a dose of a solvent of diluent and comprising a solvent container having first and second mouth portions at opposing ends, respectively, and being closed at the first mouth portion thereof by a rubber stopper, and a cylindrical connecting member for connecting the solvent container to said first container, said cylindrical connecting member being connected at one end thereof to the second mouth portion of said solvent container and sealed at the opposite end by a second sealing member.

2. The dual container system for fluid therapy according to claim 1, wherein said cylindrical connecting member has a means for engagement with the first container on an inside wall thereof, a partition wall integrally connected near the first end of said cylindrical connecting member and adjacent a connection to the solvent container, and a pushing rod extending from the central portion of the partition wall toward the opposite end of the connecting member, said partition wall having an annular brittle portion formed coaxially around the pushing rod, and several grooves formed in both sides to provide passages extending radially from the base of the pushing rod towards the brittle portion.

3. The dual container system for fluid therapy according to claim 2, wherein said engagement means comprises a female screw provided on the inside wall of the connecting member and adapted to be engaged with a male crew provided on the mouth portion of said drug container.

4. A drug container comprising:

a bottle-shaped container body having a narrowed mouth portion;

an annular packing member formed flush with an opening of said container, said annular packing member being disc-shaped with an aperture formed therein;

an annular packing seat formed at an inner periphery of the opening of said container for receiving said annular packing member;

a spherical closing member seated on the aperture of said annular packing member;

a holder engageable with said container body for holding said spherical member in place against said sealing member, said holder including an opening formed in an upper surface thereof in alignment with and of a smaller diameter than said spherical closing member; and a cover member for capping at least the narrowed mouth portion of said container, said cover member including a frangible tear strip, an enlarged annular skirt portion formed to coincide with a broadening of the narrowed mouth portion to a remainder of the container body, and a projection extending upwardly from the enlarged skirt portion.

5. The drug container according to claim 4, wherein said mouth portion further includes an O-ring sealing member at a shoulder region of said container.

6. The drug container according to claim 5, wherein a circumferential groove is provided around said container body for receiving said O-ring sealing member.

7. The drug container according to claim 4, wherein said annular packing member is made of an elastomeric material selected from the group consisting of butyl rubber, styrene-butadiene rubber, isoprene rubber, urethane rubber, and nitride rubber.

8. The drug container according to claim 4, wherein said spherical closing member is made of glass.

9. The drug container according to claim 4, wherein said spherical closing member is made of a synthetic resin.

10. The drug container according to claim 4, wherein said cover member is a cap.

11. The drug container according to claim 4, wherein said cover member is a synthetic resin sheet.

* * * * *